United States Patent [19]

Stuart

[11] 4,009,725

[45] Mar. 1, 1977

[54] GROOMING DEVICE

[76] Inventor: Fred E. Stuart, 1157 Belaire Drive, Daytona Beach, Fla. 32018

[22] Filed: July 3, 1975

[21] Appl. No.: 592,759

[52] U.S. Cl. ..... 132/11 R; 132/79 R; 132/103; 132/120

[51] Int. Cl.[2] ..... A45D 24/00

[58] Field of Search ..... 132/11, 141, 126, 120, 132/104, 79, 10, 103

[56] References Cited

UNITED STATES PATENTS

| | | | |
|---|---|---|---|
| 702,790 | 6/1902 | Gladwin | 132/10 |
| 1,258,179 | 3/1918 | Bovee | 132/104 |
| 2,192,733 | 3/1940 | Bader, Jr. | 132/73 |
| 2,281,462 | 4/1942 | Smith | 132/104 |
| 2,602,457 | 7/1952 | Mele | 132/120 |

*Primary Examiner*—G.E. McNeill
*Attorney, Agent, or Firm*—Melvin A. Crosby

[57] ABSTRACT

A grooming device in the form of a comb element, especially a pocket comb element, having coarse teeth on one end and fine teeth on the other end and a back portion extending along the root ends of the teeth. A brush element is carried on the comb near the inner ends of the fine teeth so that the comb can serve for combing the hair but, also, for brushing. The comb element may also have stiff bristles for use as a nail brush, or an additional nail brush element can be provided. The back portion of the comb may also carry a mirror element and/or a strip of abrasive material or a file element and may also be recessed for detachably receiving a coin, such as a dime. The comb may have a pocket clip connected to the back portion.

9 Claims, 8 Drawing Figures

GROOMING DEVICE

The present invention relates to a grooming device and is particularly concerned with a modified comb device.

More particularly still, the present invention relates to a grooming device which is extremely compact and which can easily be carried in the pocket and which is arranged to perform a plurality of personal grooming operations.

An object of the present invention is the provision of multiple purpose grooming device which can readily be carried about, as in a pocket like a conventional pocket comb.

Another object is the provision of a personal grooming device of the nature referred to which, at one time, will comb and brush hair and which can, also, be employed for nail cleaning purposes and the like.

BRIEF SUMMARY OF THE INVENTION

According to the present invention, a comb element similar to a pocket comb is provided with the exception that the fine teeth normally provided at one end of the comb are advantageously made somewhat shorter than the longer teeth so that the back portion of the comb connected to the base ends of the teeth has a widened region in alignment with the fine teeth of the comb.

The aforementioned widened region of the back portion is, in particular, employed for receiving a brush element having bristles upstanding at the base ends of the fine teeth whereby the brush element can be employed for brushing hair, either independently of the fine combing thereof with the fine teeth or simultaneously therewith. A region of the back portion of the comb element can also be employed to receive a file element or a strip or pad of abrasive strips for the purpose of abrading rough or sharp portions from the fingernails.

Still further, the back portion of the comb, especially on the widened portion thereof and on the side opposite the first mentioned brush element, can receive a small mirror element if so desired. Still further, the back portion of the conventional pocket comb, and especially a pocket comb constructed according to the present invention, is thick enough in the front to back direction to have a recess molded therein which is configured for receiving a coin such as a dime. A coin placed in the recess is detachably retained therein but can be removed therefrom. A coin of this nature is convenient for making telephone calls and the like.

The exact nature of the present invention will become more clearly apparent upon reference to the following detailed specification taken in connection with the accompanying drawings in which.

DETAILED DESCRIPTION OF THE INVENTION

Figure 1:
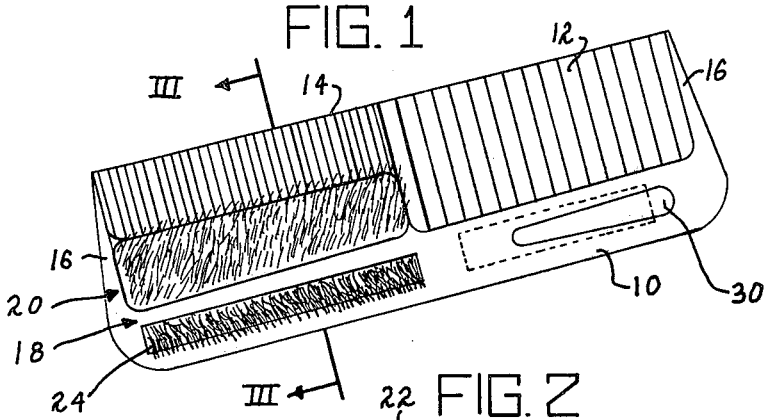
FIG. 1 is a perspective view of a grooming device according to the present invention.
Figure 2:
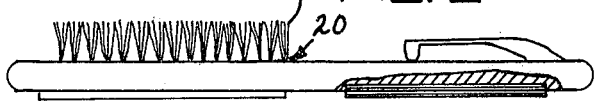
FIG. 2 is a view looking in at the back portion or rearward edge of the comb element and partly broken away.
Figure 3:
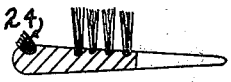
FIG. 3 is a sectional view indicated by line III—III on FIG. 1.

Referring to the drawings somewhat more in detail, the grooming device of the present invention will be seen in FIGS. 1 through 3 to comprise a comb element similar to a pocket comb and having a back portion 10 from which coarse teeth 12 project over about one-half the length of the back portion with fine teeth 14 projecting from the remainder of the back portion. A single heavy tooth 16 provided at each end protects the teeth 12 and 14 from breakage.

According to the present invention, the fine teeth 14 are shorter than is usually the case so that the back portion 10 of the comb has a substantially widened region at 18 extending over the length of the fine toothed portion of the comb element. This widened region of the back portion of the comb is availed of for receiving a brush element 20 having bristles 22 upstanding therefrom.

The brush element can be used independently for brushing hair or it can be used simultaneously with the fine teeth 14 for hair grooming. Still further, the bristles 22 may be selected to be stiff enough to permit use of the brush element 20 for a knuckle or nail brush.

According to one form of the invention, there is arranged near the top of the back portion of the comb element and on either side thereof a narrow row of bristles 24 which may be inclined at an angle. These bristles are relatively short and stiff and can be employed for cleaning of the nails.

Figure 4:
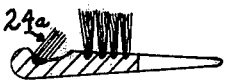
FIG. 4 is a view like FIG. 3 showing a modification.

As will be seen in FIG. 4, which shows an arrangement similar to that of FIG. 3, the bristles at 24*a*, which incline opposite to the bristles 24 of FIG. 3, can be provided for the same purpose, namely, for cleaning under the nails. The other parts of FIGS. 3 and 4 are the same and bear the same reference numerals as have been employed above.

Figure 5:
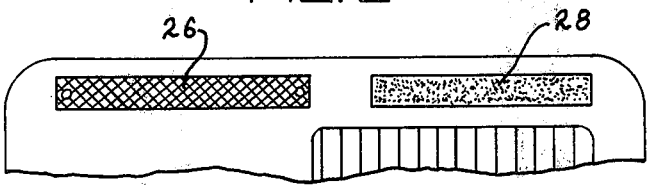
FIG. 5 is an elevational view looking in at the back portion of the comb from the side opposite that seen in FIG. 1.

FIG. 5 discloses a rearward view of the comb element, namely, from the side opposite that seen in FIG. 1. FIG. 5 will show that the back portion 10 of the cone element has mounted thereon on the side opposite brush element 20 a nail file 26 and abrasive means 28 and which latter may be in the form of a pad of a plurality of strips so that the top one can be peeled off to expose a new strip of abrasive material.

Figure 6:
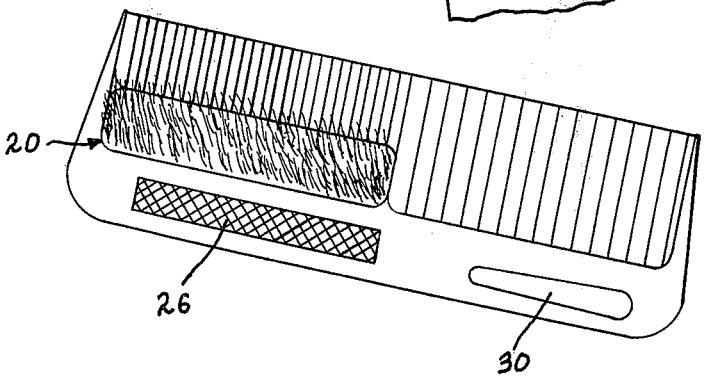
FIG. 6 is a perspective view similar to FIG. 1 but showing a modification.

As will be seen in FIG. 6, the file 26 could be mounted on the same side as the brush element 20.

In any of the modifications, the back portion may receive a pocket clip 30 for clipping the grooming device in the pocket.

Figure 7:
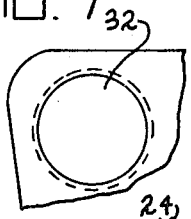
FIG. 7 is a fragmentary view showing the back portion of the comb on the rearward side of the left end of FIG. 1 and illustrating a mirror element mounted thereon.

The widened region of the back portion of the comb may also be availed of for receiving a mirror 32 as shown in FIG. 7. This mirror can be applied to the widened region of the back portion on the side opposite comb element 20 and may, for example, be about the size of a 25 cent piece. The mirror may be cemented in place or snapped into a recess and may either be silvered glass or silvered plastic or a polished metallic metal.

Figure 8:
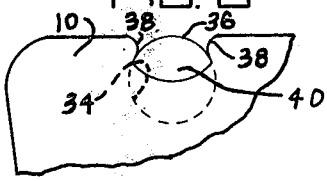
FIG. 8 is a schematic view showing how the back portion of the comb element could be provided with a recess for detachably receiving a coin.

FIG. 8 shows how back portion 10 of the comb element can have a recess 34 formed therein for receiving a coin 36 which may, for example, be a dime. The recess is deep enough to receive well over half the diameter of the coin and, at the open side, has protuberances 38 which grippingly engage the periphery of coin 36. At least one side of coin 36 is exposed as indicated at 40 so that the coin can be dislodged from the recess when it is desired to use the coin.

The grooming device of the present invention is small, inexpensive and is readily receivable in a pocket to be retained therein by the clip on the comb. The grooming device can perform a plurality of grooming functions and is, furthermore, quite convenient to use.

Modifications may be made within the scope of the appended claims.

What is claimed is:

1. In a personal grooming device; a generally flat substantially rectangular member adapted for being carried in the pocket, said member being in the form of a comb element having a back portion extending along one lateral edge of the member and teeth connected to and projecting from the back portion in the plane of said member, a brush element mounted on said back portion and upstanding therefrom substantially at right angles to the plane of said member and near the base ends of said teeth, said back portion of said comb element including recess means for detachably receiving a coin, said recess means including side portions for gripping engagement with spaced points on the periphery of the coin, said recess means exposing a portion of at least one face of the coin for engagement of the coin in the region thereof between said spaced points to assist in removing the coin from the recess.

2. A personal grooming device according to claim 1 in which said brush element comprises stiff bristle elements and is operable to cooperate with said teeth in grooming hair in a single operation and is also adapted for use as a nail or knuckle brush.

3. A personal grooming device according to claim 1 which includes abrasive means mounted on said back portion in spaced relation to said brush element and presenting an abrasive surface parallel to the plane of said member for use in grooming the nails of the hand.

4. A personal grooming device according to claim 3 in which abrasive means is a nail file.

5. A personal grooming device according to claim 3 in which said abrasive means is in the form of a pad of abrasive paper sheets from which the top sheet can be removed when worn.

6. A personal grooming device according to claim 1 in which said teeth comprise coarse teeth on one end of said back portion and fine teeth on the other end of said back portion, said brush element being mounted on said back portion within the range of said fine teeth.

7. A personal grooming device according to claim 1 in which said device has a clip attached to said back portion for clipping the device in a clothing pocket.

8. A personal grooming device according to claim 1 which includes a row of stiff bristle elements on said back portion separate from said brush element, said short bristle elements being angularly disposed relative to the plane of said flat member and adapted for use in cleaning beneath the tips of the nails of the hand.

9. A personal grooming device according to claim 8 in which said back portion comprises a longitudinal recess in which said short bristle elements are disposed and forming a guide for guiding the nails being cleaned along said row of bristles.

* * * * *